US005290160A

United States Patent [19]

Ito et al.

[11] Patent Number: 5,290,160

[45] Date of Patent: Mar. 1, 1994

[54] SCROLL TYPE FLUID MACHINERY AND ASSEMBLING METHOD OF THE SAME

[75] Inventors: Yoshiyasu Ito; Hideki Yamahira, both of Nishikasugai; Takahisa Hirano, Nagoya, all of Japan

[73] Assignee: Mitsubishi Jukogyo Kabushiki Kaisha, Tokyo, Japan

[21] Appl. No.: 35,499

[22] Filed: Mar. 22, 1993

Related U.S. Application Data

[63] Continuation of Ser. No. 707,792, May 30, 1991, abandoned.

[30] Foreign Application Priority Data

Sep. 3, 1990 [JP] Japan ..... 2-92615[U]
Sep. 4, 1990 [JP] Japan ..... 2-234047

[51] Int. Cl.[5] ..... F25B 1/04
[52] U.S. Cl. ..... 418/55.1; 29/888.022
[58] Field of Search ..... 29/888.022, 428; 418/55.1

[56] References Cited

U.S. PATENT DOCUMENTS 4,065,279 12/1977 McCullough .
4,505,655 3/1985 Honaga et al. .
4,552,517 11/1985 Shimizu ..... 418/55
4,575,319 3/1986 Terauchi ..... 418/55
4,649,611 3/1987 Ikeda et al. ..... 29/888.022
4,655,696 4/1987 Utter ..... 29/888.022
4,911,620 3/1990 Richardson, Jr. et al. .
5,015,163 5/1991 Iizuka ..... 29/888.022

FOREIGN PATENT DOCUMENTS 3542929 6/1986 Fed. Rep. of Germany .
58-170882 10/1983 Japan .
0224490 12/1984 Japan ..... 29/888.022
0186001 8/1987 Japan ..... 29/888.022

*Primary Examiner*—Irene Cuda

[57] ABSTRACT

A scroll type fluid machinery with spiral wraps set up on inner surfaces of end plates, respectively. The spiral wraps are engaged with each other at a predetermined angle dislocation and are housed in a housing with an opening in one end of a cup-shaped casing. This opening is blocked with a front case. The stationary scroll is fixed to the cup-shaped casing, and the revolving scroll is made to revolve in a solar motion by a revolution drive mechanism while checking the rotation on its axis by a mechanism for checking rotation on its axis. In an assembling method thereof, positioning portions are engaged with a positioning jig provided in the stationary scroll and the cup-shaped casing, respectively, and the positioning portions are utilized. With this machinery and method, the number of parts, working time and assembly time are reduced and the manufacturing cost may be cut down.

13 Claims, 3 Drawing Sheets

SCROLL TYPE FLUID MACHINERY AND ASSEMBLING METHOD OF THE SAME

This application is a continuation of application Ser. No. 07/707,792 filed on May 30, 1991, now abandoned.

FIELD OF THE INVENTION AND RELATED ART STATEMENT

The present invention relates to a scroll type fluid machinery used as a compressor, an expansion machine and the like and an assembling method of the same.

An assembling method of a scroll type fluid machinery of this type has been disclosed in Japanese Provisional Publication No. 59-224490 (No. 224490/1984).

This assembling method is executed as follows.

(1) A cup-shaped casing and a front case which blocks an opening at one end thereof are fastened temporarily by screwing bolts in a plurality of bolt holes which are bored on the casing and the front case.

(2) A stationary scroll and revolving scroll are engaged with each other, and positioning holes which are bored on the stationary scroll and the revolving scroll, respectively, are made to coincide with each other so as to oppose to each other at a location dislocated by approximately 90° in a reverse direction to a rotating direction of a rotary shaft from a line connecting a plurality of contact points where spiral wraps thereof are in contact with one another. Then, a positioning rod is inserted into these positioning holes from the bottom of the cup-shaped casing.

(3) The front case is rotated in a reverse direction to the rotating direction of the rotary shaft until movement is sustained.

(4) The cup-shaped casing and the front case are fastened completely with bolts.

(5) The positioning rod is pulled

With the process described above, an engagement angle between the stationary scroll and the revolving scroll is set.

A conventional assembling method of a scroll type fluid machinery required much labor as described above.

In addition, it is required to bore a through hole for inserting a positioning rod therethrough at the bottom of the cup-shaped casing, and a bolt inserted through the through hole is also screwed in a part of the positioning hole bored in the stationary scroll in order to prevent gas inside a housing constructed of the cup-shaped casing and the front case from leaking outside. Furthermore, there have been such problems that numerous components, working time and assembling time are required and the cost increases because it is required to seal the clearance between the bolt and the through hole with a seal ring and the like.

OBJECT AND SUMMARY OF THE INVENTION

It is an object of the present invention which has been made in view of such circumstances to provide a scroll type fluid machinery in which the above-described problems have been solved.

It is another object of the present invention to propose an assembling method of a scroll type fluid machinery in which the above-mentioned problems have been solved similarly.

(1) The gist of a first invention exists in a scroll type fluid machinery in which a stationary scroll and a revolving scroll having spiral wraps set up on inner surfaces of end plates, respectively, are engaged with each other at a predetermined angle dislocation and housed in a housing with one end opening of a cup-shaped casing blocked with a front case, the stationary scroll is fixed to the cup-shaped casing, and the revolving scroll is made to revolve in a solar motion by means of a revolution drive mechanism while checking the rotation on its axis by means of a mechanism for checking rotation on its axis, characterized in that positioning portions engaged with a positioning jig are provided on the stationary scroll and the cup-shaped casing, respectively.

In such a scroll type fluid machinery, there is provided an assembling method characterized in that, after positioning a stationary scroll with respect to a cup-shaped casing by having a positioning portion of the stationary scroll and a positioning portion of the cup-shaped casing engaged with a positioning jig, respectively, the stationary scroll and the cup-shaped casing are fixed to each other.

Furthermore, in the scroll type fluid machinery, there is also provided an assembling method characterized in that, after positioning a stationary scroll with respect to a cup-shaped casing by having a positioning portion of the stationary scroll and a positioning portion of the cup-shaped casing engaged with a positioning jig, respectively, the stationary scroll and the cup-shaped casing are fixed to each other and then, after a positioning portion provided on a flange end surface of a front case in which a revolving scroll, a revolution drive mechanism and a mechanism for checking rotation on its axis are incorporated and the positioning portion of the cup-shaped casing are assembled with positioning, the front case and the cup-shaped casing are fixed to each other.

The above described construction being provided according to the present invention, it is possible to fix the stationary scroll and the cup-shaped casing to each other after positioning a stationary scroll with respect to a cup-shaped casing by having a positioning portion of the stationary scroll and a positioning portion of the cup-shaped casing engaged with a positioning jig, respectively.

(2) The gist of a second invention exists in a scroll type fluid machinery in which a stationary scroll and a revolving scroll having spiral wraps set up on inner surfaces of end plates, respectively, are engaged with each other at a predetermined angle dislocation and housed in a housing with one end opening of a cup-shaped casing blocked with a front case, the stationary scroll is fixed to the casing, and the revolving scroll is made to revolve in a solar motion by means of a revolution drive mechanism while checking the rotation on its axis by means of a mechanism for checking rotation on its axis characterized in that a leg is formed on an outer surface of an end plate of the stationary scroll, positioning holes are provided on this leg and at the bottom of the cup-shaped casing, respectively, a pin is inserted into these positioning holes, and a relative angle between the stationary scroll and the cup-shaped casing is positioned through the pin.

In such a scroll type fluid machinery, there is provided an assembling method characterized in that, after a pin is inserted into positioning holes provided on the leg formed on the outer surface of the end plate of the stationary scroll and at the bottom of the cup-shaped casing, respectively, and a relative angle between the stationary scroll and the cup-shaped casing is positioned through the pin, the stationary scroll and the cup-shaped casing are fixed to each other and then, a positioning portion provided on a flange end surface of a front case in which the revolving scroll, a revolution drive mechanism and a mechanism for checking rotation on its axis are incorporated and the positioning portion of the cup-shaped casing are assembled with positioning, and the front case and the cup-shaped casing are fixed to each other thereafter.

The above-described construction being provided in the present invention, the cup-shaped casing and the stationary scroll are positioned at an accurate relative angle by means of the positioning pin. Accordingly, it is possible to assemble the stationary scroll and the revolving scroll at a predetermined angle dislocation easily and quickly.

Further scope of applicability of the present invention will become apparent from the detailed description given hereinafter. However, it should be understood that the detailed description and specific examples, while indicating preferred embodiments of the invention, are given by way of illustration only, since various changes and modification within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention and wherein:

FIG. 2 and FIG. 3 show a second embodiment of an assembling method of the present invention, in which FIG. 2 is a partial longitudinal sectional view and FIG. 3 is a partial bottom view;

DETAILED DESCRIPTION OF THE PREFERRED EMBODIMENTS

Figure 1:
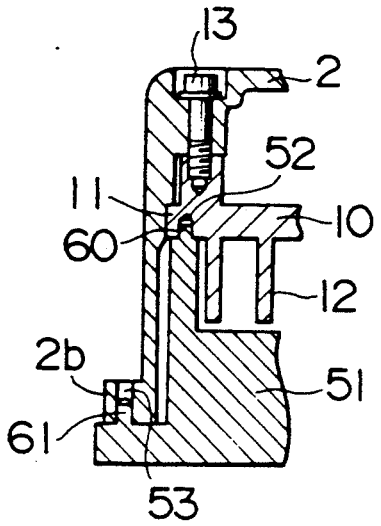
FIG. 1 is a partial longitudinal sectional view showing a first embodiment of an assembling method of the present invention.
Figure 5:
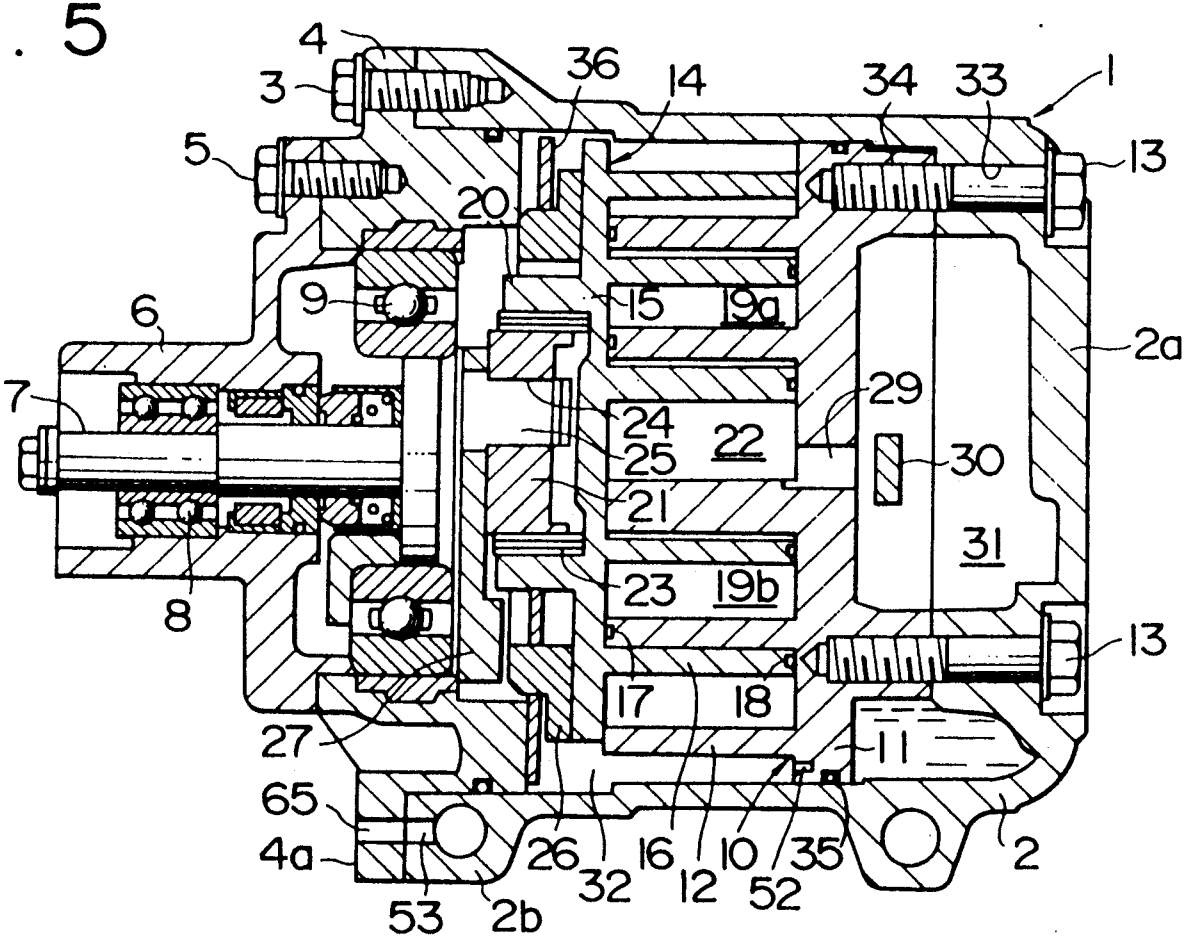
FIG. 5 is a longitudinal sectional view of a scroll type fluid machinery according to the present invention.

FIG. 1 and FIG. 5 show an embodiment of the present invention.

FIG. 5 shows a longitudinal section of a scroll type fluid machinery. In FIG. 5, a housing 1 consists of a cup-shaped casing 2, a front case 4 which blocks one end opening thereof and is fastened thereto with a bolt 3, and a front cover 6 fastened to the front case with a bolt 5. A rotary shaft 7 which penetrates through the front cover 6 is supported rotatably by the housing 1 through bearings 8 and 9.

A stationary scroll 10 and a revolving scroll 14 are disposed inside the housing 1.

The stationary scroll 10 is provided with an end plate 11 and a spiral wrap 12 which is set up on the inner surface thereof. The outer circumferential surface of the end plate 11 is attached closely to the inner circumferential surface of the cup-shaped casing 2 through a seal ring 35, thereby to partition the inside of the housing 1. With this, a discharge cavity 31 is defined on the outer surface side of the end plate 11, and a suction chamber 32 is defined on the inner surface side. Then, bolts 13 are inserted through a plurality of bolt holes 33 which are bored on a bottom 2*a* of the cup-shaped casing 2, respectively. Further, the stationary scroll 10 is fixed to the cup-shaped casing 2 by screwing tips of these bolts 13 into screw holes 34 bored in the end plate 11 and fastening the tips thereto.

The revolving scroll 14 is provided with an end plate 15 and a spiral wrap 16 which is set up on the inner surface thereof, and the spiral wrap 16 has substantially the same configuration as that of the spiral wrap 12.

The revolving scroll 14 and the stationary scroll 10 are made eccentric with each other by a predetermined distance, and are engaged with each other while shifting the angle by 180° as shown in the figure. Chip seals 17 buried on a tip surface of the spiral wrap 12 come in close contact with the inner surface of the end plate 15, tip seals 18 buried on a tip surface of the spiral wrap 16 come in close contact with the inner surface of the end plate 11, and side surfaces of the spiral wraps 12 and 16 come in linear contact with each other at a plurality of locations. In such a manner, a plurality of closed small chambers 19*a* and 19*b* which form almost point symmetry with respect to the center of the spiral are defined.

Inside a cylindrical boss 20 projected at a central portion of the outer surface of the end plate 15, a bushing 21 is inserted rotatably through a slewing bearing 23, and an eccentric pin 25 projected at an inner end of the rotary shaft 7 is fitted rotatably in an eccentric hole 24 bored in the bushing 21. Further, a balance weight 27 is fixed to the bushing 21.

A thrust member 36 and a mechanism 26 for checking rotation on its axis such as an Oldham's link are interposed between the outer circumferential edge of the outer surface of the end plate 15 and the end surface of the front case 4.

Now, when the rotary shaft 7 is rotated, the revolving scroll 14 is driven through a revolution drive mechanism consisting of the eccentric pin 25, the bushing 21, the slewing bearing 23, the boss 20 and the like, and the revolving scroll 14 revolves in a solar motion while being prevented from rotation on its axis by the mechanism 26 for checking rotation on its axis.

The linear contact portion between spiral wraps 12 and 16 moves gradually toward the center of the spiral by revolution in a solar motion of the revolving scroll 14. As a result, the closed small chambers 19*a* and 19*b* move toward the center of the spiral while reducing the volume thereof.

Then, gas is suctioned into a suction chamber 32 through a suction port not shown and is taken into the closed small chambers 19*a* and 19*b* through outer end opening portions of the spiral wraps 12 and 16, and reaches a central chamber 22 while being compressed. The gas passes therefrom through a discharge port 29 bored in the end plate 11 of the stationary scroll 10, pushes a discharge valve 30 open and is discharged into a discharge cavity 31, and is discharged further to the outside of the housing 1 through a discharge port not shown.

At least one positioning hole 52 which stretches axially is bored on the outer circumferential edge on the inner surface of the end plate 11 of the stationary scroll 10, and at least one positioning hole 53 which stretches axially is bored on a flange 2*b* on the opening end side of the cup-shaped casing 2.

In the next place, an assembling method of the fluid machinery will be described with reference to FIG. 1.

The stationary scroll 10 is fitted into the cup-shaped casing 2, then a pin 60 provided on a jig 51 is inserted into the positioning hole 52 while inserting the tip of the positioning jig 51 into the cup-shaped casing 2, and a pin 61 is inserted into a positioning hole 53 at the same time. Thus, the cup-shaped casing 2 and the stationary scroll 10 are positioned at a regular relative angle through the jig 51.

Next, the cup-shaped casing 2 and the stationary scroll 10 are fixed to each other by having a plurality of bolts 13 penetrate through bolt holes 33 and screwing the tips thereof into screw holes 34.

On the other hand, the revolving scroll 14 and the front case 4 are assembled at a regular relative angle by incorporating the front cover 6, the revolving scroll 14, revolution drive mechanisms 7, 8, 9, 21, 23 and 24, the mechanism 26 for checking rotation on its axis, the thrust member 36 and the like into the front case 4.

A positioning hole 65 provided on an end surface of a flange 4*a* of the front case 4 is made to match with the positioning hole 53 of the cup-shaped casing 2, and the front case 4 and the cup-shaped casing 2 are fixed with a bolt 3 after adjusting these holes at a regular relative angle.

Thus, the stationary scroll 10 is fixed to the cup-shaped casing 2 at a regular relative angle, and the revolving scroll 14 is incorporated in the front case 4 at a regular relative angle. Therefore, the stationary scroll 10 and the revolving scroll 14 are engaged with each other at a predetermined angle dislocation of 180° by fixing the cup-shaped casing 2 and the front case 4 at a regular relative angle.

Figure 2:
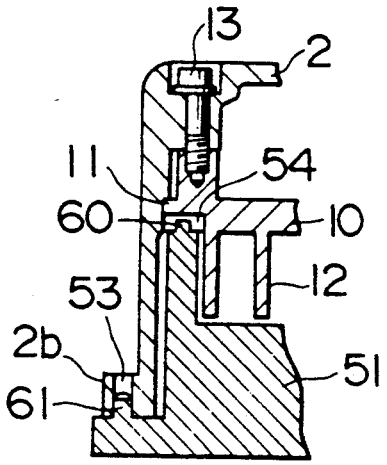
Figure 3:
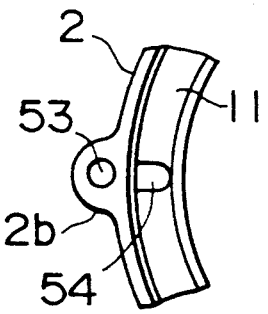

In above-described first embodiment, positioning is made by inserting a pin 60 of the jig 51 into the positioning hole 52, but, as shown in FIGS. 2 and 3, it is also possible to position the stationary scroll 10 and the positioning jig 51 at a regular relative angle by boring a positioning slit 54 extending radially on an outer circumferential edge of the inner surface of the end plate 11 of the stationary scroll 10 and fitting the pin 60 of the jig 51 to the positioning slit 54.

Figure 4:
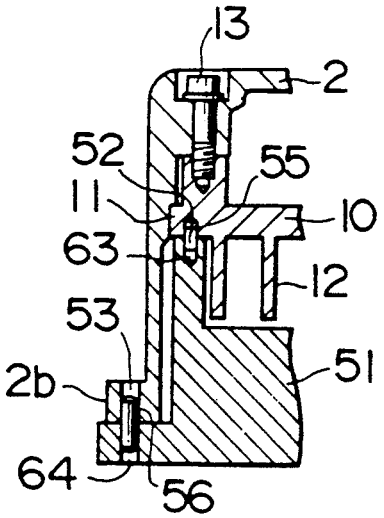
FIG. 4 is a partial longitudinal sectional view showing a third embodiment of an assembling method of the present invention.

Further, as shown in FIG. 4, it is possible to position the relative angle between the stationary scroll 10 and the cup-shaped casing 2 by boring positioning holes 63 and 64 in the positioning jig 51, inserting a positioning pin 55 so as to extend over the positioning hole 52 provided on the end plate 11 of the stationary scroll 10 and a positioning hole 63 of the jig 51, and inserting a positioning pin 56 so as to extend over the positioning hole 53 provided on a flange 2*b* of the cup-shaped casing 2 and the positioning hole 64 of the jig 51.

Besides, although not shown in the figure, the positioning hole 52 can be provided on the tip surface of the spiral wrap 12 of the stationary scroll 10, and a slit, a projected bar and the like may also be provided on the inner circumferential surface of the cup-shaped casing 2 in place of the positioning hole 53.

Further, the mechanism 26 for checking rotation on its axis consisting of an Oldham's link is provided in above-mentioned embodiment, but a mechanism for checking rotation on its axis having other type and structure may also be used.

As described above, according to the present invention, positioning portions are provided on the stationary scroll and the cup-shaped casing, respectively, and these positioning portions are engaged with the positioning jig, thereby to fix the stationary scroll and the cup-shaped casing with each other after positioning the stationary scroll with respect to the cup-shaped casing. Accordingly, it is possible to assemble a scroll type fluid machinery easily and quickly in a state that the stationary scroll and the revolving scroll are engaged with each other at a predetermined relative angle.

Being different from a conventional machinery, it is not required to bore a through hole for inserting a positioning rod in the cup-shaped casing and bolt and seal ring for blocking the hole are not required. Thus, number of parts, working time and assembly time are reduced and the cost may be cut down.

Figure 6:
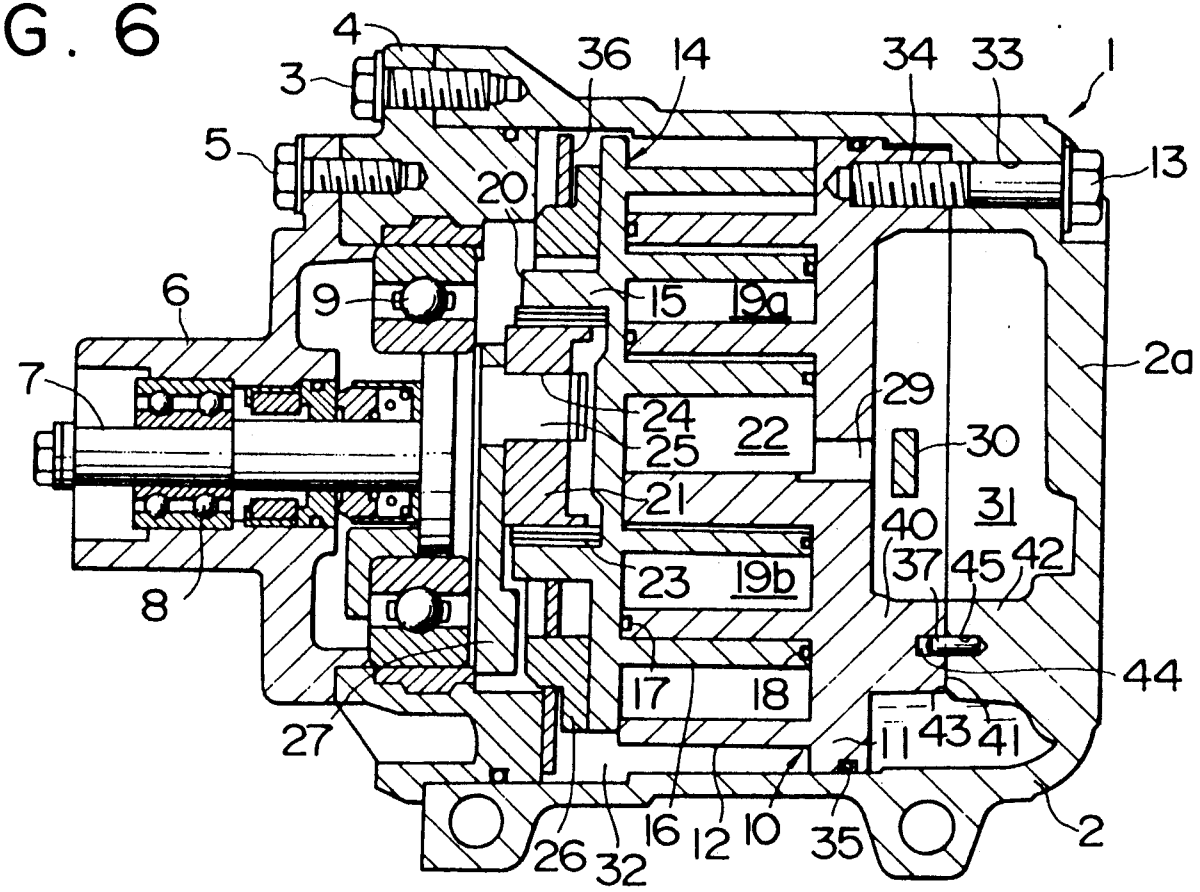
FIG. 6 is a longitudinal sectional view showing another embodiment of a scroll type fluid machinery of the present invention.

FIG. 6 shows another embodiment of the present invention. In FIG. 6, same symbols are assigned to those members that are the same as FIG. 5, and description thereof will be omitted.

In FIG. 6, a leg 40 protruding outwardly is formed on the outside surface of the end plate 11 of the stationary scroll 10, and a tip surface 41 of the leg 40 abuts against a tip surface 43 of a leg 42 protruding inwardly from the bottom 2*a* of the cup-shaped casing 2.

A positioning hole 44 having a predetermined depth is bored on the tip surface 41, and a positioning hole 45 having a predetermined depth which opposes to the positioning hole 44 is bored on the tip surface 43 when the stationary scroll 10 and the cup-shaped casing 2 occupy a regular relative angle position, and a pin 37 is inserted into these positioning holes 44 and 45 extending thereover.

Then, an assembling method of the fluid machinery will be described.

The revolving scroll 14, revolution drive mechanisms 7, 8, 9, 21, 23, 24 and 25 thereof, the mechanism 26 for checking rotation on its axis thereof, the thrust member 36 and the like are assembled in the front case 4 and the front cover 6. With this, the revolving scroll 14 and the front case 4 are assembled at a regular relative angle.

Next, after inserting the tip of the pin 37 into the positioning hole 44 of the stationary scroll 10 and exposing the rear end thereof, the stationary scroll 10 is placed in the cup-shaped casing 2 and rotated appropriately, thereby to insert the rear end of the pin 37 into the positioning hole 45 and to make the tip surface 41 abut against the tip surface 43 at the same time.

Thereafter, the cup-shaped casing 2 and the stationary scroll 10 are fastened to each other using a bolt 13. With this, the cup-shaped casing 2 and the stationary scroll 10 are assembled at a regular relative angle.

Then, the preassembled revolving scroll 14 is engaged with the stationary scroll 10, and the front case 4 and the cup-shaped casing 2 are fastened with the bolt 3 at a regular relative angle thereafter.

One piece of pin 37 is used in the illustrated embodiment, but a plurality of pins may be used, too.

Further, a case in which an Oldham's link is used as the mechanism 26 for checking rotation on its axis has been described, but other mechanism for checking rotation on its axis may also be used.

As described above, a leg is formed on an outer surface of an end plate of the stationary scroll, positioning holes are provided on the leg and at the bottom of the cup-shaped casing, respectively, and a pin is inserted into these positioning holes so as to position a relative angle between the stationary scroll and the cup-shaped casing in the present invention. Thus, it is possible to assemble a scroll type fluid machinery easily and quickly so that the stationary scroll and the revolving scroll show a predetermined angle dislocation. Further, being different from a conventional machinery, it is not required to bore a through hole for inserting a positioning rod in the cup-shaped casing, and a bolt and a sealing ring for blocking the hole are neither required. Thus, number of parts, working time and assembly time are reduced and the cost may be cut down.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A scroll type fluid machinery comprising:

a housing having a cup-shaped casing with an opening at one end thereof, the housing further having a front casing, the front casing closing the opening and the cup-shaped casing having a flange and bolt hole defined therein;

a stationary scroll and a revolving scroll each having spiral wraps set up at inner surfaces of end plates thereof, the scrolls being arranged in the housing in engagement with each other at a predetermined angle, said stationary scroll being fixed to said casing;

a revolution drive mechanism for moving said revolving scroll in a solar motion and a mechanism for checking rotation of the revolving scroll, the revolution drive mechanism and the mechanism for checking being located in the housing;

the inner surface of the end plate of the stationary scroll at a circumferential edge thereof having at least one opening defined therein and the flange of the cup-shaped casing having another at least one opening defined therein, the at least one opening defined in the flange being on a side facing the opening of the cup-shaped casing, both of the at least one openings allowing the stationary scroll and the cup-shaped casing to assume the predetermined angle therebetween and a position between said stationary scroll and said cup-shaped casing being determined at a relative angle by means of a positioning jig provided with positioning pins, at least one of the pins engaging the at least one opening defined in the stationary scroll and at least one of the pins engaging the at least one opening defined in the flange, the stationary scroll having a bolt hole, the bolt holes of the stationary scroll and cup-shaped casing being aligned when both of the at least one openings are engaged by the pin of the positioning jig;

a bolt positionable in the bolt holes of the stationary scroll and the cup-shaped casing for holding the stationary scroll fixed to the cup-shaped housing; and the front casing having a positioning hole defined therein, said positioning hole matching a position of the at least one opening defined in the cup-shaped casing to thereby determine positioning of the front casing and the cup-shaped casing at the relative angle.

2. The scroll type fluid machinery according to claim 1, wherein each of the at least one openings in the stationary scroll is one of a hole and slit and wherein each of the at least one openings in the flange is one of a hole and slit.

3. A scroll type fluid machinery comprising:

a housing having a cup-shaped casing with an opening at one end thereof, the housing further having a front casing, the front casing closing the opening;

a stationary scroll and a revolving scroll each having spiral wraps set up at inner surfaces of end plates thereof, the scrolls being arranged in the housing in engagement with each other at a predetermined angle, said stationary scroll being fixed to said casing;

a revolution drive mechanism for moving said revolving scroll in a solar motion and a mechanism for checking rotation of the revolving scroll, the revolution drive mechanism and the mechanism for checking being located in the housing;

at least one leg on the end plate of the stationary scroll and at least one leg on a bottom of said cup-shaped casing, each of said legs on the end plate having a matching leg on the cup-shaped casing, each leg having an end surface with a positioning hole defined therein, and end surfaces of matching legs contacting one another;

a pin insertable in both of the positioning holes of each of the matching legs for positioning the stationary scroll and said cup-shaped casing with the predetermined angle therebetween to thereby determine positioning between said stationary scroll and said cup-shaped casing;

both of said front casing and said cup-shaped casing having at least one positioning bolt hole defined therein, the bolt holes being aligned when the front casing is to be mounted on the cup-shaped casing whereby a position at a regular angle between the front casing and the cup-shaped casing can be determined;

both said cup-shaped casing and the stationary scroll having at least one bolt hole defined therein, the bolt holes in the cup-shaped casing and the stationary scroll being aligned when the pin is inserted into the positioning holes of each of the matching legs whereby the aligned bolt holes form bolt hole pairs; and bolts positionable in each of the bolt hole pairs to hold the stationary scroll fixed to the cup-shaped housing.

4. A scroll type fluid machinery comprising:

a housing having a cup-shaped casing with an opening at one end thereof, the housing further having a front casing, the front casing closing the opening in the cup-shaped casing, the housing having a generally central, longitudinal axis;

a stationary scroll and a revolving scroll each having spiral wraps set up at inner surfaces of end plates thereof, the scrolls being arranged in the housing in engagement with each other at a predetermined angle, both the stationary scroll and the cup-shaped casing having bolt holes defined therein;

a bolt positionable in the bolt holes of the stationary scroll and the cup-shaped casing for holding the stationary scroll fixed to said cup-shaped casing;

a revolution drive mechanism for moving said revolving scroll in a solar motion and a mechanism for checking rotation of the revolving scroll, the revolution drive mechanism and the mechanism for checking being located in the housing;

first means for aligning the stationary scroll within the cup-shaped casing such that the stationary scroll can be fixed to the cup-shaped casing; and second means for aligning the front casing with the cup-shaped casing such that the front casing can be fixed to the cup-shaped casing, the second means, and at least a part of the first means being different distances from the generally central longitudinal axis of the housing and the first and second means being used sequentially.

5. The scroll type fluid machinery according to claim 4, wherein the cup-shaped casing further comprises a flange adjacent the end having the opening and wherein the part of the first means comprises at least one opening defined in the stationary scroll and wherein the first means also comprises at least one opening defined in the flange, the at least one opening in the flange being on a side thereof facing the opening of the cup-shaped casing, the first means further simultaneously receiving a jig in the at least one opening in the stationary scroll and the at least one opening in the flange to thereby align the stationary scroll and cup-shaped casing.

6. The scroll type fluid machinery according to claim 5, wherein each of the at least one openings in the stationary scroll is one of a hole and slit.

7. The scroll type fluid machinery according to claim 5, wherein the second means further comprises a positioning hole defined in the front casing, the positioning hole being aligned with the at least one opening defined in the flange after the jig is removed from the at least one opening of the stationary scroll and the at least one opening of the flange, the scroll type fluid machinery further comprising means for affixing the front casing to the cup-shaped casing after the second means aligns the front casing and the cup-shaped casing.

8. The scroll type fluid machinery according to claim 4, wherein the second means further comprises a positioning hole defined in the front casing and the part of the first means comprises at least one opening defined in a flange on the cup-shaped casing, the positioning hole and the at least one opening on the flange being aligned, the scroll type fluid machinery further comprising means for affixing the front casing to the cup-shaped casing after the positioning hole and the at least one opening are aligned.

9. The scroll type fluid machinery according to claim 4, wherein the first means comprises at least one leg on the end plate of the stationary scroll and at least one leg on a bottom of said cup-shaped casing, each of said legs on the end plate having a matching leg on the cup-shaped casing, each leg having an end surface with a positioning hole defined therein and end surfaces of matching legs contacting one another, the first means further comprising pins insertable in both of the positioning holes of each of the matching legs to thereby position the stationary scroll with the cup-shaped casing.

10. The scroll type fluid machinery according to claim 9, wherein the second means comprises a positioning bolt hole defined in both of said front casing and said cup-shaped casing, the bolt holes being aligned when the front casing is to be mounted on the cup-shaped casing.

11. A process for assembling a scroll type fluid machinery comprising the steps of:

providing a housing having a cup-shaped casing with an opening at one end thereof the housing further having a front casing, the front casing closing the opening and the cup-shaped casing having a flange and a bolt hole defined therein;

providing a stationary scroll and a revolving scroll each having spiral wraps set up at inner surfaces of end plates thereof, the stationary scroll having a bolt hole defined therein;

positioning the scrolls in the housing in engagement with each other at a predetermined angle;

providing at least one opening on both of the stationary scroll and the cup-shaped casing, an inner edge of the inner surface of the end plate of the stationary scroll at a circumferential edge thereof having the at least one opening defined therein and the flange of the cup-shaped casing having the at least one opening defined therein, the at least one opening defined in the flange being on a side facing the opening of the cup-shaped casing;

fixing the predetermined angle relationship between the stationary scroll and the cup-shaped casing by the at least one of the openings in the end plate of the stationary scroll and the flange of the cup-shaped casing;

inserting pins formed on a positioning jig in the at least one of the openings in the end plate of the stationary scroll and in the at least one of the openings in the flange of the cup-shaped casing during the step of fixing, the pins on the positioning jig aligning the stationary scroll and the cup-shaped casing, the bolt hole in the stationary scroll being aligned with the bolt hole in the cup-shaped casing;

inserting a bolt into the aligned bolt holes of the stationary scroll and cup-shaped casing to fix the stationary scroll to the cup-shaped casing;

providing a revolution drive mechanism for moving said revolving scroll in a solar motion and a mechanism for checking rotation of the revolving scroll;

locating the revolution drive mechanism and the mechanism for checking in the housing;

providing at least one positioning hole in the front casing and at least one positioning hole in the cup-shaped casing;

aligning the at least one positioning holes in the front casing and the cup-shaped casing; and fixing the front casing to the cup-shaped casing using said positioning hole with a relative angle being formed therebetween.

12. The process for assembling a scroll type fluid machinery according to claim 11, wherein each of the at least one openings in the stationary scroll is one of a hole and slit and wherein each of the at least one openings in the flange is one of a hole and slit.

13. A process for assembling a scroll type fluid machinery comprising the steps of:

providing a housing having a cup-shaped casing with an opening at one end thereof, the housing further having a front casing, the front casing closing the opening, the cup-shaped casing having a bolt hole defined therein;

providing a stationary scroll and a revolving scroll each having spiral wraps set up at inner surfaces of end plates thereof, the stationary scroll having a bolt hole defined therein;

positioning the scrolls in the housing in engagement with each other at a predetermined angle;

providing at least one leg on the end plate of the stationary scroll and at least one leg on a bottom of said cup-shaped casing, each of the at least one legs on the end plate having a matching leg on the cup-shaped casing, each leg having an end surface with a positioning hole defined therein;

touching the end surface of each of the at least one legs on the end plate with the end surface of a matching leg on the cup-shaped casing;

inserting a pin in each of the positioning holes of the matching legs when the end surfaces of the matching legs are touching, the pin fixing the predetermined angle between the stationary scroll and cup-shaped casing to thereby determine positioning between the stationary scroll and the cup-shaped housing, the bolt hole in the stationary scroll being aligned with the bolt hole in he cup-shaped casing;

inserting a bolt into the aligned bolt holes of the stationary scroll and cup-shaped casing to fix the stationary scroll to the cup-shaped casing;

providing a revolution drive mechanism for moving said revolving scroll in a solar motion and a mechanism for checking rotation of the revolving scroll;

locating the revolution drive mechanism and the mechanism for checking in the housing;

providing at least on positioning bolt hole in the front casing and in the cup-shaped casing;

aligning the bolt holes when the front casing is to be mounted on the cup-shaped casing; and fixing the front casing to the cup-shaped casing using the bolt holes to thereby determine a regular angle between the front casing and the cup-shaped casing.

* * * * *